US012098481B2

(12) United States Patent
Ford et al.

(10) Patent No.: US 12,098,481 B2
(45) Date of Patent: Sep. 24, 2024

(54) CELLULOSIC FIBER PROCESSING

(71) Applicant: North Carolina State University, Raleigh, NC (US)

(72) Inventors: Ericka N. Ford, Raleigh, NC (US); Ryan Dwyer, Raleigh, NC (US); Hannah Dedmon, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 596 days.

(21) Appl. No.: 17/282,435

(22) PCT Filed: Oct. 4, 2019

(86) PCT No.: PCT/US2019/054879
§ 371 (c)(1),
(2) Date: Apr. 2, 2021

(87) PCT Pub. No.: WO2020/073010
PCT Pub. Date: Apr. 9, 2020

(65) Prior Publication Data

US 2021/0388533 A1 Dec. 16, 2021

Related U.S. Application Data

(60) Provisional application No. 62/742,033, filed on Oct. 5, 2018.

(51) Int. Cl.
*D01F 1/10* (2006.01)
*D01D 1/02* (2006.01)
(Continued)

(52) U.S. Cl.
CPC ..... *D01F 1/10* (2013.01); *D01D 1/02* (2013.01); *D01D 5/06* (2013.01); *D01D 10/02* (2013.01);
(Continued)

(58) Field of Classification Search
None
See application file for complete search history.

(56) References Cited

U.S. PATENT DOCUMENTS 3,689,622 A * 9/1972 Kawai ..... D01D 5/22 264/188
3,776,994 A 12/1973 Yoshioka et al.
(Continued)

FOREIGN PATENT DOCUMENTS

CA 2132816 A1 3/1995
CN 101830015 A 9/2010
(Continued)

OTHER PUBLICATIONS

Machine Translation of CN105970325 (Year: 2019).*
(Continued)

*Primary Examiner* — Shawn Mckinnon
(74) *Attorney, Agent, or Firm* — Michael Best & Friedrich LLP

(57) ABSTRACT

Strengthening the dry and wet tenacity of regenerated cellulosic fibers can be performed through the addition of an aldaric acid, such as (but not limited to) glucaric acid. In some embodiments, regenerated cellulosic fibers that include an aldaric acid or a salt thereof, produced by the disclosed methods are also described. The produced fibers have advantageous properties due at least in part to the inclusion of the aldaric acid.

21 Claims, 11 Drawing Sheets

(51) Int. Cl.

| | |
|---|---|
| ***D01D 5/06*** | (2006.01) |
| ***D01D 10/02*** | (2006.01) |
| ***D01F 2/02*** | (2006.01) |
| ***D01F 2/28*** | (2006.01) |

(52) U.S. Cl.
CPC ..... *D01F 2/02* (2013.01); *D01F 2/28* (2013.01); *D10B 2401/061* (2013.01); *D10B 2401/063* (2013.01)

(56) References Cited

U.S. PATENT DOCUMENTS

| | | | |
|---|---|---|---|
| 5,358,702 | A | 10/1994 | Unger |
| 5,401,576 | A | 3/1995 | Yoon et al. |
| 5,409,532 | A | 4/1995 | Astegger et al. |
| 6,270,567 | B1 | 8/2001 | Matsuo et al. |
| 7,045,184 | B2 | 5/2006 | Scott et al. |
| 7,267,696 | B2 | 9/2007 | Desenne et al. |
| 2004/0054069 | A1 | 3/2004 | Kusudou et al. |
| 2009/0082493 | A1 | 3/2009 | Taylor et al. |
| 2011/0003148 | A1 | 1/2011 | Lee et al. |
| 2011/0040029 | A1 | 2/2011 | Glaser |
| 2015/0037241 | A1 | 2/2015 | Lehmann et al. |

FOREIGN PATENT DOCUMENTS

| | | | | |
|---|---|---|---|---|
| CN | 105970325 | | * | 1/2019 |
| DE | DD142898 | | * | 7/1980 |
| EP | 0146084 | A2 | | 6/1985 |
| EP | 0775486 | A1 | | 5/1997 |
| GB | 482664 | A | | 4/1938 |
| JP | S37-012016 | B | | 8/1962 |
| JP | 84716724 | A | | 9/1972 |
| JP | 85035427 | A | | 4/1975 |
| JP | H02221406 | A | | 9/1990 |
| JP | 09241301 | A | | 9/1997 |
| JP | H09241301 | | * | 9/1997 |
| JP | H1199090 | A | | 4/1999 |
| JP | 2002088246 | A | | 3/2002 |
| JP | 2003238921 | A | | 8/2003 |
| JP | 2004339643 | A | | 12/2004 |
| JP | 2008285611 | A | | 11/2008 |
| RU | 2246459 | C2 | | 2/2005 |
| WO | 1997043771 | A1 | | 11/1997 |
| WO | 1999058468 | A1 | | 11/1999 |
| WO | 2004030661 | A2 | | 4/2004 |
| WO | 2006073540 | A2 | | 7/2006 |
| WO | 2009036479 | A1 | | 3/2009 |
| WO | 2009144081 | A1 | | 12/2009 |
| WO | 2011066191 | A1 | | 6/2011 |
| WO | 2012156441 | A1 | | 11/2012 |
| WO | 2013023432 | A1 | | 2/2013 |
| WO | WO2013150475 | | * | 10/2013 |
| WO | 20180187710 | A1 | | 10/2018 |

OTHER PUBLICATIONS

Machine Translation of DD142898 (Year: 1980).*
Machine Translation of JPH09241301 (Year: 1997).*
Ajji et al., "Preparation of poly(vinyl alcohol) hydrogels containing citric or succinic acid using gamma radiation," Radiation Physics and Chemistry, 2005, 74(1):36-41.
Arafat et al., "Biomimetic wet-stable fibres via wet spinning and diacid-based crosslinking of collagen triple helices," Polymer, 2015, vol. 77, pp. 102-112.
Awada et al., "Chemical Modification of Poly(Vinyl Alcohol) in Water," Appl. Sci., 2015, vol. 5, pp. 840-850.
Birck et al., "New crosslinked cast films based on poly(vinyl alcohol): Preparation and physico-chemical properties," Express Polymer Letter, 2014, 8(12):941-952.
Bolto et al., "Crosslinked poly(vinyl alcohol) membranes," Progress in Polymer Science, 2009, 34(9):969-981.
Chae et al., "Stabilization and carbonization of gel spun polyacrylonitrile/single wall carbon nanotube composite fibers," Polymer, 2007, 48(13):3781-3789.
Chunhong, Lu, "Investigating the Structural and Mechanical Reinforcement Mechanisms of Gel Spun Lignin/Polyvinyl Alcohol Fibers" Doctoral Dissertation, Aug. 2017.
Conte et al., "Development of immobilized lysozyme based active film," Journal of Food Engineering, 2007, 78 (3):741-745.
Figueiredo et al., "Poly(vinyl alcohol) films crosslinked by glutaraldehyde under mild conditions," Journal of Applied Polymer Science, 2009, 111(6):3074-3080.
Gohil et al., "Studies On The Crosslinking Of Poly (Vinyl Alcohol)," Journal of Polymer Research, 2006, 13(2):161-169.
Hasimi et al., "Transport of water in polyvinyl alcohol films: Effect of thermal treatment and chemical crosslinking," European Polymer Journal, 2008, 44(12):4098-4107.
Liu et al., "Gel spinning of polyacrylonitrile fibers with medium molecular weight," Polymer International, 2011, 60 (3):453-457.
Lu et al., "Antiplasticizing Behaviors of Glucarate and Lignin Bio-Based Derivates on the Properties of Gel-Spun Poly (Vinyl Alcohol) Fibers," Macromol. Mater. Eng., Apr. 2018, vol. 303, Issue 4, Article 1700523, 16 pages.
Lu et al., "Effect of the Coagulation Bath on the Structure and Mechanical Properties of Gel-Spun Lignin/Poly(vinyl alcohol) Fibers," ACS Sustainable Chem. Eng., Feb. 2017, 5(4) 2949-2959.
Mansur et al., "FTIR spectroscopy characterization of poly (vinyl alcohol) hydrogel with different hydrolysis degree and chemically crosslinked with glutaraldehyde," Materials Science and Engineering: C, 2008, 28(4):539-548.
Martel et al., "Finishing of Polyester Fabrics with Cyclodextrins and Polycarboxylic Acids as Crosslinking Agents," Journal of Inclusion Phenomena and Macrocyclic Chemistry, 2002, 44(1):443-446.
Martel et al., "Water-soluble polymers and gels from the polycondensation between cyclodextrins and poly(carboxylic acid)s: A study of the preparation parameters," Journal of Applied Polymer Science, 2005, 97(2):433-442.
Nalankilli, "Gel Spinning—A Promising Technique for the Production of High Performance Fibres," Man-Made Textiles in India, 1997, 40(6):237-242.
Ruckenstein et al., "Preparation and characteristics of polymer-based large adsorbent particles," Journal of Applied Polymer Science, 1996, 61(11):1949-1956.
Salt et al., "Pervaporation separation of ethylacetate-water mixtures through a crosslinked poly(vinylalcohol) membrane," Vacuum, 2005, 79(3-4):215-220.
Shi et al., "The effect of citric acid on the structural properties and cytotoxicity of the polyvinyl alcohol/starch films when molding at high temperature," Carbohydrate Polymers, 2008, 74(4):763-770.
Smith et al., "Tensile Strength of Highly Oriented Polyethylene. II. Effect of Molecular Weight Distribution," Journal of Polymer Science Part B: Polymer Physics, 1982, vol. 20, pp. 2229-2241.
Sonker et al., "Effects of tungsten disulphide nanotubes and glutaric acid on the thermal and mechanical properties of polyvinyl alcohol," Composite Science and Technology, 2016, vol. 127, pp. 47-53.
Tan et al., "Gel-Spun Polyacrylonitrile Fiber From Pregelled Spinning Solution," Polymer Engineering and Science, 2010, 50(7):1290-1294.
Wang et al., "Properties of polyvinyl alcohol/xylan composite films with citric acid," Carbohydrate Polymers, 2014, vol. 103, pp. 94-99.
Zhu Shaozhong et al., "Applied Chemistry Manual", p. 461, Shanghai Science and Technology Press, Feb. 1989 (3 pages with machine translation).
Chinese Patent Office Notification of First Office Action for application 201980064708.4, dated Apr. 23, 2023 (13 pages with translation).
European Patent Office Extended Search Report for Application No. 19868678.4 dated Apr. 17, 2023 (9 pages).
Japan Patent Office Notice of Reasons for Refusal for application 2021-517940, dated Jul. 6, 2023 (12 pages with machine translation).
International Search Report and Written Opinion for Application No. PCT/US2019/054879 dated Dec. 18, 2019 (7 pages).

(56) References Cited

OTHER PUBLICATIONS

International Preliminary Report on Patentability for Application No. PCT/US2019/054879 dated Mar. 23, 2021 (5 pages).
Lu, "Investigating the Structural and Mechanical Reinforcement Mechanism of Gel-Spun Lingnin/Poly(vinyl alcohol) Fibers", phD dissertation, Fiber and Polymer Science, North Carolina State University, 2017, pp. 90-98.
Japanese Patent Office Action for Application 2019-554803, mailed on Sep. 20, 2022 (4 pages with translation).
Korean Patent Office Action for Application 10-2019-7032554, mailed on Sep. 30, 2022, (13 pages with translation).
Indian Patent Office Action for Application 202117018663, mailed on Oct. 18, 2022, (6 pages with translation).
Indonesian Patent Office Action for Application P00202102276, mailed on Nov. 11, 2022, (6 pages with translation).
Indonesian Patent Office Action for Application P00202102276, mailed on Feb. 15, 2024, (5 pages with translation).

* cited by examiner

CELLULOSIC FIBER PROCESSING

CROSS-REFERENCE TO RELATED APPLICATIONS

This application is a national phase filing under 35 U.S.C. § 371 of International Application No. PCT/US2019/054879, filed Oct. 4, 2019, which claims priority to U.S. Provisional Patent Application No. 62/742,033, filed Oct. 5, 2018, the entirety of which is hereby incorporated by reference.

TECHNICAL FIELD

The presently disclosed subject matter is directed to producing cellulosic fibers. More particularly, the present disclosure relates to systems and methods for cellulosic fiber strengthening using aldaric acids.

INTRODUCTION

Materials constructed from cellulosic fibers are widely used, especially in the packaging and clothing industries where strength is required. Substrates constructed from cellulosic materials are frequently strengthened by the addition of polymeric materials. However, such polymeric materials commonly impart undesirable characteristics to the cellulosic materials, such as a reduced sensitivity to moisture vapor, water, and/or solvents. Further, materials treated with polymeric materials often result in products that are excessively rigid and/or brittle. In addition, the cost to produce polymer-based fibers with increased strength (e.g., high-performance fibers) can be excessive, making such fibers cost-prohibitive.

SUMMARY

The instant disclosure is directed to cellulosic fiber strengthening. In one aspect, a method for processing cellulosic fiber includes combining cellulosic material and aldaric acid in a first solvent to produce a first mixture including 0.1-10 weight percent aldaric acid, agitating the first mixture, thereby dissolving the cellulosic material and producing a first solution, spinning the first solution to produce a cellulosic fiber solution, extruding the cellulosic fiber solution into a first bath comprising a second solvent to provide an as-spun fiber, and thermally drawing the as-spun fiber through a second bath comprising oil to produce a regenerated fiber.

In some embodiments, the aldaric acid is glucaric acid.

In some embodiments, the cellulosic fiber is present in the first mixture at a concentration of about 60% to about 99.9% by weight/volume.

In some embodiments, the first solvent is an aprotic solvent, an ionic organic hydrate, or an aqueous solvent. In some instances, the first solvent includes a lithium halide. In some instances, the first solvent includes an antioxidant, such as a gallate.

In some embodiments, the second solvent comprises methanol, acetone, isopropanol, water, or combinations thereof.

In some embodiments, the cellulosic material is activated cellulose powder. In some instances, the activated cellulose powder is derived from cotton waste or agricultural waste.

In some embodiments, the method further includes adding one or more additives to the neutralized cellulose solution before extruding the neutralized cellulose solution. In various embodiments, the one or more additives may include water repellants, coloring agents, UV stabilizers, UV absorbers, UV blockers, antioxidants, stabilizing agents, fire retardants, and combinations thereof.

In some embodiments, the method further includes aging the as-spun fiber to provide an aged as-spun fiber, where the aged as-spun fiber is subjected to drawing.

In some embodiments, the method further includes generating the cellulosic material by a method including: milling cellulose starting material to generate a fine cellulose powder, mercerizing the fine cellulose powder in aqueous sodium hydroxide, neutralizing the mercerized solution with an acid, adding sodium hydroxide and then raising the temperature of the resulting solution followed by cooling to room temperature, and centrifuging the cooled solution.

In some embodiments, the presently disclosed subject matter is directed to regenerated cellulosic fibers produced by the disclosed methods.

In some embodiments, the regenerated cellulosic fiber comprises an average diameter of about 10-50 μm.

In some embodiments, the regenerated cellulosic fiber comprises a tenacity of greater than about 5 g/den.

In some embodiments, the regenerated cellulosic fiber comprises a specific modulus of greater than about 250 g/den.

In some embodiments, the regenerated cellulosic fiber comprises a tensile strength of greater than about 500 MPa.

In some embodiments, the regenerated cellulosic fiber comprises a linear density of less than about 15 denier.

In some embodiments, the regenerated cellulosic fiber is melt-blown, spunbond, or as-spun.

In some embodiments, the presently disclosed subject matter is directed to a fibrous article comprising the disclosed fiber.

In some embodiments, the fibrous article is selected from the group consisting of yarn, fabric, melt-blown web, spunbonded web, as-spun web, thermobonded web, hydroentangled web, nonwoven fabric, or combinations thereof.

There is no specific requirement that a material, technique or method relating to cellulosic fiber processing include all of the details characterized herein, in order to obtain some benefit according to the present disclosure. Thus, the specific examples characterized herein are meant to be exemplary applications of the techniques described, and alternatives are possible.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION

Figure 1:
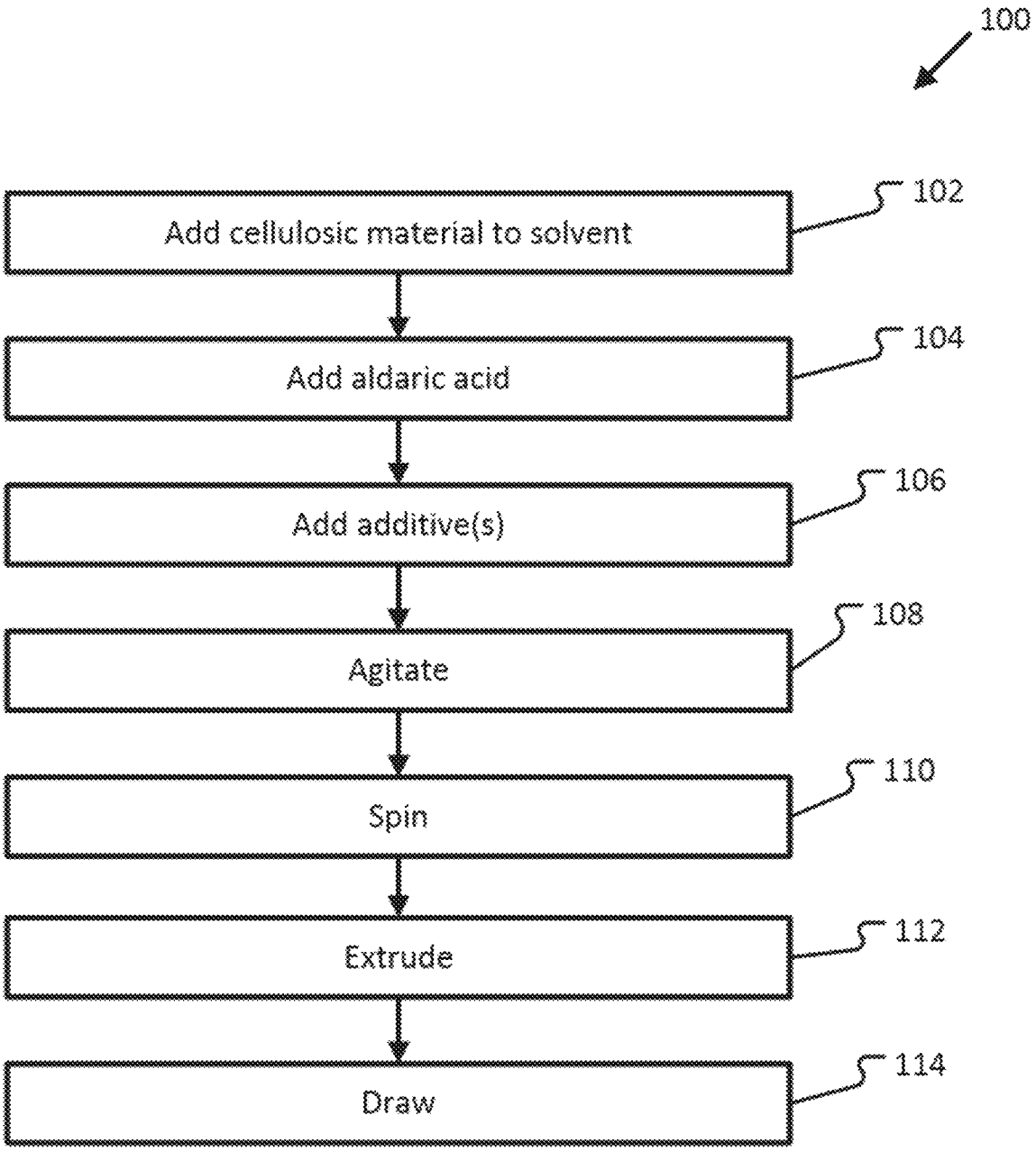
FIG. 1 shows an example method for processing cellulosic fiber.

The present disclosure is directed to strengthening the dry and wet tenacity of regenerated cellulosic fibers. More particularly, processes disclosed herein strengthen cellulosic fibers through the addition of an aldaric acid, such as (but not limited to) glucaric acid or galactaric acid. In some instances, regenerated cellulosic material can be processed and used as starting material, such as pre- and post-consumer cotton waste, agricultural waste (e.g., sugarcane bagasse), and used paper products. That said, methods and techniques disclosed herein may also be applied to native (i.e., not regenerated) cellulosic fibers.

Regenerated cellulosic fibers are typically weaker than natural cellulosic fibers. Particularly, due to the decreased molecular weight of regenerated cellulosic fibers, thermochemical processing is needed to improve mechanical performance. Using the disclosed method, the wet and dry tenacity of regenerated cellulose fibers can be improved by the addition of an aldaric acid into the spinning dope (spinning solution).

The term "tenacity" refers to the unit tensile strength of the monofilament fiber, calculated by dividing the tensile force at break by its linear density. Wet tenacity and dry tenacity refer to the tensile testing of the fibers while dry and wet, respectively. The wet and dry tenacity of a fiber can be determined in accordance with ASTM D3822-07, the entire content of which is incorporated by reference herein. In some embodiments, the presently disclosed subject matter further includes regenerated cellulosic fibers that include an aldaric acid or a salt thereof, produced by the disclosed methods. Without being bound by a particular theory, it appears that the produced fibers have advantageous properties at least in part because of the inclusion of the aldaric acid.

I. DEFINITIONS

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," and variants thereof are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The term "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" can refer to plus or minus 10% of the indicated number. For example. "about 10%" can indicate a range of 9% to 11%, and "about 1" can mean from 0.9-1.1. Other meanings of "about" can be apparent from the context, such as rounding off, so, for example "about 1" can also mean from 0.5 to 1.4.

Definitions of specific functional groups and chemical terms are described in more detail below. For purposes of this disclosure, the chemical elements are identified in accordance with the Periodic Table of the Elements, CAS version, Handbook of Chemistry and Physics, 75th Ed., inside cover, and specific functional groups are generally defined as described therein. Additionally, general principles of organic chemistry, as well as specific functional moieties and reactivity, are described in Organic Chemistry, Thomas Sorrell, University Science Books, Sausalito, 1999; Smith and March March's Advanced Organic Chemistry, 5th Edition, John Wiley & Sons, Inc., New York, 2001; Larock, Comprehensive Organic Transformations, VCH Publishers, Inc., New York, 1989; Carruthers, Some Modern Methods of Organic Synthesis, 3rd Edition, Cambridge University Press, Cambridge, 1987; the entire contents of each of which are incorporated herein by reference.

II. EXEMPLARY MATERIALS USABLE IN EXAMPLE METHODS AND SYSTEMS

Various types of cellulosic fibers can be used in exemplary methods and systems disclosed herein. These and other materials usable in example methods and systems are discussed below.

A. Cellulosic Fibers

Cellulosic fibers are a type of fiber constructed from pulp (e.g., wood pulp) using a solvent fiber spinning process. Any desired pulp can be used, such as (but not limited to) hardwood pulp, softwood pulp, cotton linters, bagasse, hemp, flax, bamboo, kenaf, grass, straw, linseed, jute, ramie, bast, sisal, and/or any other plants having fibrous phloem. Suitable hardwood pulp can be selected from one or more of acacia, alder, birch, gmelina, gum, maple, oak, eucalyptus, poplar, beech, aspen, and the like. Suitable softwood pulp can be selected from one or more of Southern pine, White pine, Caribbean pine, Western hemlock, spruce, Douglas fir, and the like.

Regenerated cellulosic fibers are fibers that have been prepared by regeneration (e.g., return to solid form) from a solution that includes dissolved cellulosic fiber. As set forth in more detail herein below, the disclosed method comprises dissolving the cellulosic material in a solvent (the spinning dope), and spinning the resultant solution into fibers. It has been found that the addition of an aldaric acid (e.g., glucaric acid) into the spinning dope strengthens the resultant regenerated fibers.

B. Example Solvents with Aldaric Acids

Certain solvents used during operations of example methods disclosed herein include aldaric acid. Solvents discussed in this section are used during dissolution operations of cellulosic material.

1. Exemplary Aldaric Acids

Aldaric acids are a group of sugar acids, wherein the terminal hydroxyl and carbonyl groups of the sugars have been replaced by terminal carboxylic acids. Aldaric acids can be characterized by the formula HOOC—(CHOH)n—COOH. Examples of aldaric acids suitable for use in the disclosed method include glucaric acid, tartaric acid, galactaric acid (also known as mucic acid), xylaric acid, ribaric acid, arabinaric acid, ribaric acid, lyxaric acid, mannaric acid, and/or idaric acid.

in some embodiments, the selected aldaric acid is glucaric acid or a salt thereof. Particularly, the glucaric acid can include the diacid form of glucaric acid, the lactone form (e.g., 1,4-lactone and 3,6-lactone), or combinations thereof.

The glucaric acid can be a salt and can be fully or partially neutralized. Counter ions of the glucaric acid salt can include (hut are not limited to) sodium, potassium, ammonium, zinc, lithium, or combinations thereof. For example, the glucaric acid can be a mono-ammonium salt, a di-ammonium salt, a sodium salt, a potassium salt, or combinations thereof. Without being bound by a particular theory, it is believed that glucaric acid's free hydroxyl and carboxylic acid groups engage in strong intermolecular, secondary bonding with matrix polymer, in particular the hydroxyl groups of dissolved cellulose polymers.

In some embodiments, the glucaric acid can have the formula set forth in Formula (I).

Formula (I)

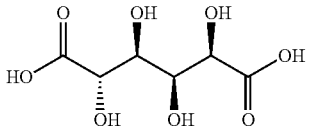

However, in some embodiments, the glucaric acid can have the formula set forth below as Formula (II).

Formula (II)

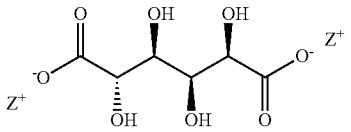

In Formula (II), Z+ can be selected from hydrogen, sodium, potassium. N(R1)4, zinc, lithium, and combinations thereof.

In some embodiments, the glucaric acid can be selected from one or more of Formulas (III), (IV), or (V).

Formula (III)

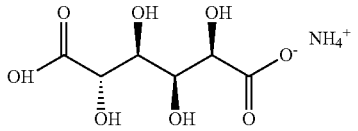

Formula (IV)

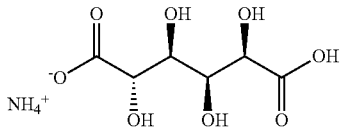

Formula (V)

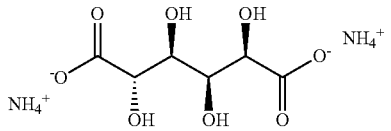

In some embodiments, the glucaric acid can be provided through one or more biosynthesis methods. For example, the glucaric acid can be provided via microorganism fermentation. As such, the glucaric acid can be provided in a cost-effective manner. In other embodiments, the glucaric acid can be provided through the oxidization of a sugar (e.g., glucose) with an oxidizing agent (e.g., nitric acid).

2. Additional Exemplary Solvent Components

Generally, example solvents used to dissolve cellulosic material are aprotic, ionic organic hydrates, or aqueous. In various implementations, example solvents can include lithium halides. In various implementations, example solvents can include antioxidants. Some example solvents can include both lithium halides and antioxidants. As indicated above, aldaric acid is added to these solvent systems.

Solvent media can be aprotic solvents. Example aprotic solvents usable in methods and systems disclosed herein include, sometimes in combination with salts, dimethyl acetamide (DMAc), dimethyl formamide (DME), n-methylformamide (NMF), dimethyl sulfoxide (DMSO), 1-methyl- 2-pyrrolidinone (NMP), and methyl-pyrrolidones.

Solvent media can be ionic organic hydrates. Example ionic organic hydrates include N-Methylmorpholine-N-Oxide (NMO), diallylintidazolium methoxyacetate ([A2im.][$CH_3OCH_2COO$]), pyridinium, and imidazolium with anions of acetic acid, formic acid, dimethyl phosphate, and chlorine.

Solvent media can be aqueous based. For instance, example solvent may be aqueous sodium hydroxide (NaOH) or aqueous urea.

In some instances, the aprotic solvent, the ionic organic hydrate solvent, or the aqueous solvent can also include lithium halides. Example lithium halides include lithium chloride (LiCl), lithium fluoride (LiF), and lithium bromine (LiBr). In some instances, the solvent, such as NMO, can effectively dissolve cellulosic material without lithium halides.

In various implementations, lithium halides may be present in the solvent at 3-20 wt/v %; from 5 wt/v % to 15 wt/v %; from 4 wt/v % to 10 wt/v %; from 7 wt/v % to 12 wt/v %; from 12 wt/v % to 18 wt/v %; from 3 wt/v % to 9 wt/v %; or from 8 wt/v % to 14 wt/v % of the solution.

The solvent can also include one or more antioxidants. Example antioxidants include gallates, such as for instance, dodecyl gallate, propyl gallate, and lauryl gallate can be added. The one or more gallates may be added to the solvent at about 0.1 wt/v % to 0.3 wt/v %, or about 0.2 wt/v %.

III. EXAMPLE METHODS

A. Exemplary Cellulose Activation

Typically, feedstock for example cellulosic fiber processing disclosed below is pre-processed to generate "activated cellulosic powder." Activated cellulose powder may be obtained in a variety of ways, such as by milling or grinding cellulose starting material, which may be cellulose cake, to a fine powder. In some instances, the powder is 20 metal mesh size (about 840 μm). The resulting powder can be dried after milling. For instance, the powder can be oven dried at 85° C. for at least 4 hours. In some implementations, the powder may be stored in a desiccator before further processing.

Then the fine powder is mercerized in aqueous solvent, such as sodium hydroxide (NaOH). Mercerization can occur at room temperature. Mercerization is the caustic treatment of cellulose that swells fibers by disrupting hydrogen bonding between cellulose chains. Treatments comprise up to 25% sodium hydroxide in water at room or lower temperatures. For example, mercerization can include treating the dried powder with 20 w/v % aqueous sodium hydroxide (NaOH) at 23° C. for 5 hours.

In some implementations, the fibers may be rinsed and collected after mercerization and dried (e.g., at 80° C.). Experimental testing has indicated that drying the fibers after mercerizing, and before neutralizing, can improve dissolution of cellulose in downstream processes (such as after spinning operation 110, discussed below).

Then the NaOH/milled cellulose mixture is neutralized with a strong acid or weak acid. As one example, the pH may be neutralized with 4N sulfuric acid. Next the fibers may be rinsed and collected, and then dried. For instance, drying can occur at 80° C.

Next, the dried powder may be added to a dissolving solvent, which may be NaOH with urea, or DMAc/LiCl. In some instances, the dissolving solvent may include lauryl gallate. In some instances, the temperature of the solution may be increased to 120° C. to 130° C. and then lowered to room temperature. Then, the resulting dopes may be centrifuged to fully dissolve fibrils and de-aerate the dope.

B. Exemplary Cellulosic Fiber Processing

FIG. 1 shows example method 100 for processing cellulosic fiber. Generally, method 100 results in cellulosic fibers having improved strength properties compared to the starting material cellulosic fibers. Starting material for method 100 can include recycled fibers and/or native fibers. Other embodiments can include more or fewer operations.

Method 100 includes combining cellulosic material and aldaric acid in a first solvent to produce a first mixture, which is described below as operations 102, 104, and 106. Method 100 can begin by adding cellulosic material (operation 102) to a first solvent. Typically, cellulosic material is activated cellulose powder. Usually, the cellulosic material has been pre-dried. In various implementations, cellulosic material is added such that the cellulosic material is present in the solution at a concentration of about 60% to about 99.9% by weight/volume.

Various desired solvents can be used as first solvents in operation 102. Exemplary solvents are an aprotic solvent, an ionic organic hydrate, or an aqueous solvent. In some instances, the first solvent includes a lithium halide. In some instances, the first solvent includes an antioxidant, such as a gallate. Example solvents, potential components, and possible relative amounts are described in greater detail above and not repeated here for purposes of brevity.

Alternatively, an indirect dissolution process may be used, such as the viscose rayon process. In the viscose rayon process, cellulose is combined with $CS_2$ to form cellulose xanthogenate, which is soluble in aqueous NaOH, creating a viscose solution for fiber spinning. The spun fiber is treated with acid solution to transform the derivative back into cellulose, Aldaric acid is also added to the first solvent (operation 104). In some instances, aldaric acid is added (operation 104) before the cellulosic material is added or dissolved in the solvent. Exemplary aldaric acids include, but are not limited to, glucaric acid and galactaric acid. The aldaric: acid is added to the solution (operation 104) such that the aldaric acid is present in the solution at a concentration of about 0.01% to about 10% by weight/volume.

Optionally, one or more additives may be added (operation 106) to the first solvent, which may be a mixture of solvent, cellulosic material, and aldaric acid. The one or more additives may include water repellents, coloring agents, stabilizers, absorbers, UV blockers, antioxidants, stabilizing agents, fire retardants, and combinations thereof.

Next, the solution is agitated (operation 108). Agitation (operation 108) can include stirring the solution at a desired temperature for a desired time. In some embodiments (e.g., depending on the solvent used), the desired temperature can be room temperature. However, in some embodiments, the desired temperature can be greater (e.g., about 60° C.-100° C.) or less than (e.g., about 10° C. or less) room temperature. The desired time can range from about 15 minutes to several hours.

Then the solution can be spun (operation 110) using any known method to dissolve cellulosic material in the solution. As one example, the solution may be centrifuged during operation 108. In other implementations, sonication, ultrasonication, high shear homogenization, and knead reacting may be used to dissolve cellulosic material in the solution.

Next, the solution can be extruded (operation 112) into a second solvent to provide an as-spun fiber. The second solvent can comprise methanol, acetone, isopropanol, water, or a combination thereof. In some instances, an air gap is provided between the extruding apparatus and the bath. The dry jet of dope in the air gap can allow the entangled polymer chains to elongate prior to coagulation in the second solvent.

In some embodiments, method 100 can include thermally drawing (operation 114) the as-spun fiber through a bath comprising an oil (e.g., silicone oil) to produce the regenerated fiber. In some instances, the as-spun fiber may be aged in the second solvent before drawing the aged or as-spun fiber through the bath comprising oil. However, it should be appreciated that, in some embodiments, a meltblown, spunbond, and/or as-spun process can be used. Accordingly, the fiber can be a meltblowm fiber, spunbond fiber, and/or an as-spun fiber.

IV. EXEMPLARY SYSTEM

Figure 2:
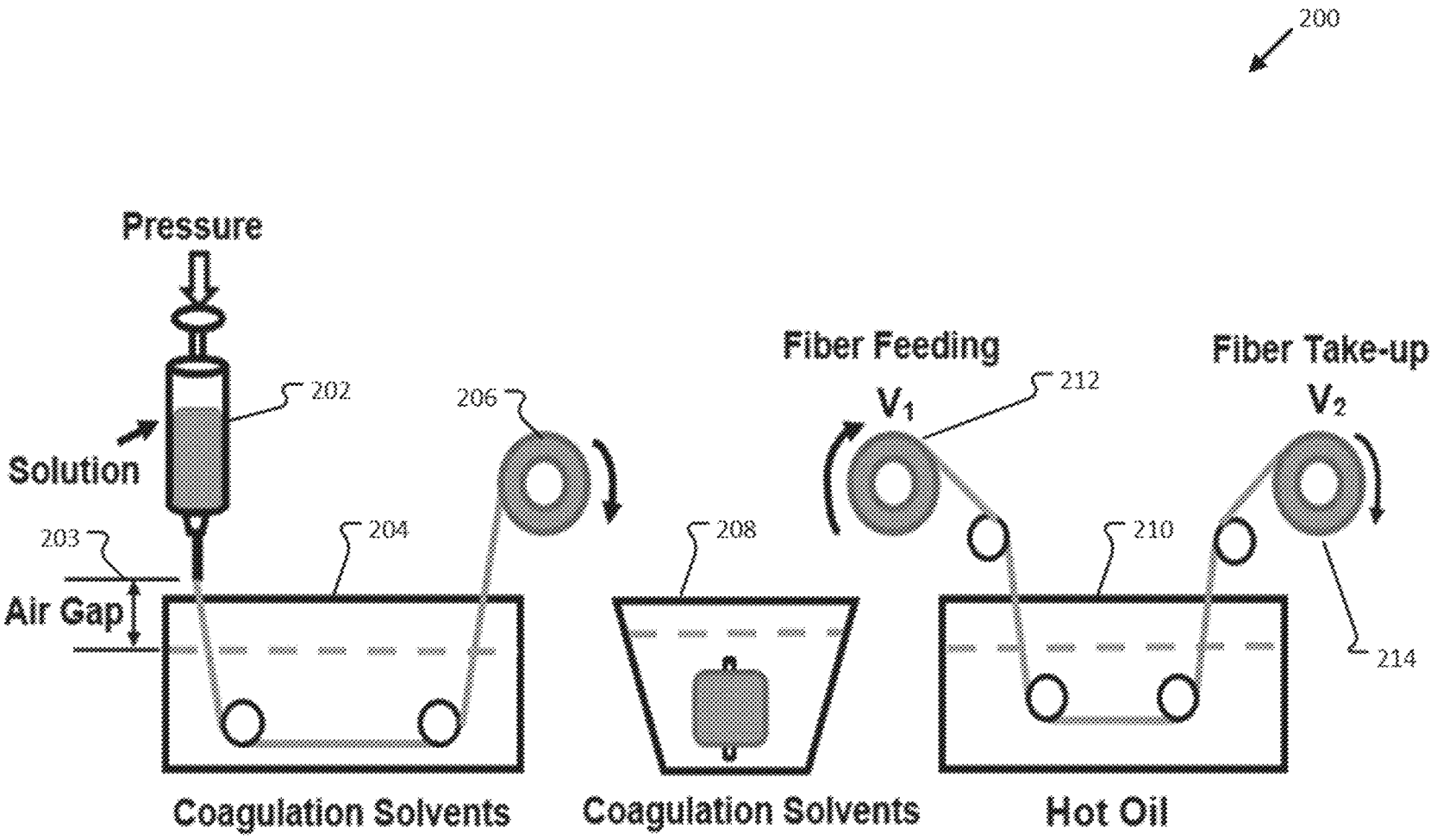
FIG. 2 shows a schematic diagram of an example system for extruding, aging and drawing cellulosic fiber.

FIG. 2 shows a schematic diagram of example system 200 for extruding and drawing cellulosic fiber, One or more components shown in system 200 can be used to implement operation 112 and operation 114 of method 100, discussed above. Other embodiments can include more or fewer components.

System 200 includes extrusion apparatus 202 which can generate extruded cellulosic fiber, such as an as-spun fiber. Typically, a mixture including dissolved cellulosic fiber at a neutral pH is provided to extrusion apparatus 202. As pressure is applied to extrusion apparatus 202, the cellulosic fiber passes through an orifice into bath 204. The diameter of the orifice and pressure applied can vary depending on the type of fiber desired. For example, an orifice can be supplied via a 19-gauge needle having an inner diameter of about 0.69 mm.

Between extrusion apparatus 202 and bath 204 is air gap 203. The air gap between the orifice and the first bath can be from about 1 mm to about 10 mm, such as from about 2 mm to about 8 min; from 3 mm to 5 mm; or from about 2 mm to about 7 mm.

Bath 204 includes one or more solvents that may be at a higher or lower temperature than the solution in extrusion apparatus 202. Solvent in bath 204 may include methanol, acetone, isopropanol, water or combinations thereof in some embodiments, the solvent in bath 204 is at 0° C., −10° C., −20° C., −25° C., or −35° C., and includes a mixture of methanol and acetone. The as-spun fiber, following coagulation in the first bath, can be collected onto rotating winder 206.

Once the as-spun fiber is generated, it can be aged within bath 208 that includes the same or similar solvents as the bath 204, but typically at a higher temperature (e.g., greater than 0° C.) than the bath 204 to provide an aged as-spun fiber. As-spun fibers can be aged for about 1 hour to about 48 hours. In some embodiments, the as-spun fiber is aged in bath 208 at 5° C. for 24 hours. Through this step the as-spun fibers (and aged as-spun fibers) may also be referred to as polymer gels.

Then, fibers may be drawn through one to four stages of oil in bath 210. An example oil is silicone oil. Typically, oil in bath 210 is at elevated temperatures compared to bath 204 and bath 208, for instance, oil in bath 210 may be at 90° C. to 240° C. The draw ratio (DR) at each stage of fiber drawing can be calculated as $DR=V_2/V_1$, where $V_1$ is the velocity of the fiber feeding winder 212 and $V_2$ is the velocity of the fiber take-up winder 214.

Varying feed rates and draw ratios can be used in the disclosed methods. For example, the method may include feed rates of from about 0.1 meters/minute (m/min) to about 20 m/min. In addition, the method may include draw ratios of from about 1 to about 20. In some embodiments, the method may have a total draw ratio of from about 25 to about 160, such as from about 30 to about 150 or from about 35 to about 85. As used herein, "total draw ratio" refers to the cumulative draw ratio of each draw stage performed in bath 210 comprising silicone oil.

V. ASPECTS OF EXEMPLARY REGNEERATED FIBERS

Exemplary regenerated fibers can be described in terms of various components and chemical characteristics as well as physical properties of the fibers. Various aspects are discussed below.

A. Components of Exemplary Regenerated Fibers

In some embodiments, the regenerated fibers can include one or more additives that instill one or more beneficial properties to the fibers. The term "additive" refers to water repellants, coloring agents, UV stabilizers, UV absorbers, UV blockers, antioxidants, stabilizing agents, fire retardants, or any other compound that enhances the appearance or performance characteristics of the produced fibers. Suitable additives can include (but are not limited to) lignin, carbon nanotubes, nanofillers, or combinations thereof. The additive can be present within the fiber at a concentration of about 0.1-50 weight percent, based on the total weight of the fiber. Thus, the additive(s) can be present in an amount of about 1-45, 5-30, or 10-20 weight percent.

In some embodiments, the disclosed regenerated fibers can comprise lignin. Lignin is a complex polymer that is part of the secondary cell wall in plants and some algae, filling in the spaces between cellulose, hemicellulose, and pectin forming the cell wall. Lignin binds covalently to hemicellulose, cross-linking different polysaccharides and thus increases the mechanical strength of the cell wall. In some embodiments, the regenerated fibers can comprise about 0.1-50 weight percent lignin, based on the total weight of the fibers. For example, the lignin content of the regenerated fibers can comprise about 1-25, 1-30, 5-30, or 8-20 weight percent lignin.

Lignin can be used in a variety of forms. For example, lignin can be provided as an aqueous pine sawdust paste. In addition, lignin provided as solution can have an acidic pH, such as a pH 2-4. In some embodiments, the lignin can be purified by dissolving in a solvent (e.g., acetone) and then filtering to remove insoluble lignin fractions. Purifying the lignin can improve drawability (e.g., higher fiber stretch and/or less breaks during drawing) of the resultant fibers.

The regenerated fiber can have any desired diameter, depending on the production method used. For example, the fiber can have a diameter of about 10-50 μm, such as about 15-45, 20-40, or 25-35 μm.

Due at least in part to the aldaric acid, the disclosed regenerated cellulosic fiber can have increased tenacity compared to regenerated fibers produced in the absence of aldaric acid. Particularly, the disclosed regenerated fiber can have a tenacity of at least 1.5×, 2×, 2.5×, 3×, 4×, 5×, or 10× regenerated cellulosic fiber produced in the absence of aldaric acid. For example, the disclosed regenerated fiber can have a tenacity of about 3-15 g/den. Thus, the regenerated fiber can have a tenacity of greater than about 5, 6, 7, 8, or 9 g/den, greater than 6 g/den, greater than 7 g/den, greater than 8 g/den, or greater than 9 g/den.

In some embodiments, the regenerated cellulosic fibers can have an aldaric acid concentration of about 0.01% to about 10% based on the total weight of the fiber. Thus, the fiber can comprise about 0.01% to 8%, 0.8% to 5%, or 1% to 4% aldaric acid.

B. Example Physical Characteristics of Exemplary Generated Fibers

In some embodiments, the produced fiber can have a specific modulus of from about 200 g/den to about 1200 g/den. Thus, the fiber can have a specific modulus of greater than about 230, 250, 300, 350, 400, or 450 g/den. The term "specific modulus" refers to the modulus of elasticity (Young's modulus) divided by the volumetric mass density of the material (e.g., weight per unit volume). Young's modulus is a mechanical property that measures the stiffness of a material (e.g., uniaxial stress or force per unit surface divided by strain). Specific modulus and Young's modulus can be determined in accordance with ASTM D3039 and ASTM D790, incorporated by reference herein.

The fiber can have a tensile strength of from about 150 MPa to about 2000 MPa. The fiber can have a tensile strength of greater than 500 MPa, greater than 550 MPa, greater than 600 MPa, greater than 650 MPa, greater than 700 MPa, greater than 750 MPa, greater than 800 MPa, greater than 900 MPa, or greater than 1000 MPa. The tensile strength of a material refers to the maximum amount of stress that can be applied to the material before rupture or failure (e.g,, how quickly and/or easily a fiber will tear or rip).

In some embodiments, the produced fiber can have a linear density of about 3-30 denier, such as about 3-25, 3-20, or 3-15 denier, In some embodiments, the regenerated cellulosic fibers can have a linear density of less than about 17 denier, such as less than about 16, 15, 14, 13, 12, 11. 10, 9, 8, 7, 6, or 5 denier.

As mentioned above, the regenerated fiber can be used in a number of different applications due to its advantageous properties. One such application is the use of the fiber as part of a fibrous article, such as (but not limited to) yarn, fabric, melt-blown web, spunbonded web, gel-spun web, needle punched web, thermobonded web, hydroentangled web, nonwoven fabric, and a combination thereof.

In addition, the fiber can be used in applications where high-performance fibers are needed. Examples of these type of applications include precursors for carbon fibers, tire cords, radiation shieldings, and fiber reinforced plastics.

VI. EXPERIMENTAL EXAMPLES

The compositions and methods of the invention will be better understood by reference to the following examples, which are intended as an illustration of and not a limitation upon the scope of the invention.

Example 1: Mercerization Pretreatment of Cellulose 3.0±0.05 grams of milled cellulose powder was added to 500 mL cold (23° C.) 20% NaOH solution. The suspension was mechanically stirred for 1 hour. Solids were then filtered and washed with until the filtrate was neutralized (pH 6-7). The treated cellulose was then air dried. It was observed that the cellulose was dissolved into an almost transparent solution.

Example 2: Mercerization Pretreatment of Cotton Pulp

A 20% NaOH aqueous solution was prepared. 3.0±0.05 grams cotton pulp was added to the 20% NaOH solution and stirred at 250 rpm for 1 hour at room temperature (20-23° C.). The solution was filtered using fine steel mesh and a Buchner funnel under vacuum. The filtered dried pulp was added to 30 mL white vinegar (5% acetic acid) and stirred for 5-10 minutes to neutralize the pH of the solution to 6-7. The solution was filtered through fine steel mesh using a Buchner funnel under vacuum. The filtered pulp was added to 60 mL distilled water and stirred for 5-10 minutes at room temperature. The water rinsing and filtering steps were repeated until the pulp was washed well (pH neutralized, sodium removed). The pulp was then dried in an oven at 85° C. for at least 4 hours. The dried pulp was stored in a vacuum sealed desiccator at room temperature until used for dissolution or characterization studies.

Example 3: NaOH Pretreatment Role on Dissolution

A 3 wt % cellulose milled recycled cotton sample without mercerization pretreatment was added to a solution of 8% LiCl/DMAc+0.2 weight percent dodecyl gallate+10 weight percent glucaric acid. The solution was stirred at 120° C. (oil bath) for 1 hour. The solution was stirred for an additional hour at room temperature. Dope samples were taken for centrifugation (2500 rpm, 20 minutes), and the supernatant was applied for drop testing.

It was observed that the sample did not fully dissolve. The sample also did not appear to have high viscosity. After centrifugation, sediment was observed, indicating a very poor dissolution condition.

The coagulation test (in water) resulted in a weak drop that was easily broken apart. It was therefore concluded that the mercerization pretreatment is an important step for the LiCl/DMAc dissolution process, having an impact on the dissolution efficiency for the milled cellulose samples.

Example 4: Anti-Plasticizer Effects

Anti-plasticizer has been known to enhance drawability and/or mechanical strength of fibers. Sample 1 was prepared by adding cellulose fiber (600-800 degree of polymerization) to a solution of 3 wt % DMAc/LiCl. Sample 2 was prepared by adding cellulose fiber (600-800 degree of polymerization) to a solution of 10% glucaric acid. SEM images of the resultant fibers of Samples 1 and 2 are shown in FIG. 3A and FIG. 3B, respectively.

Figure 3A:
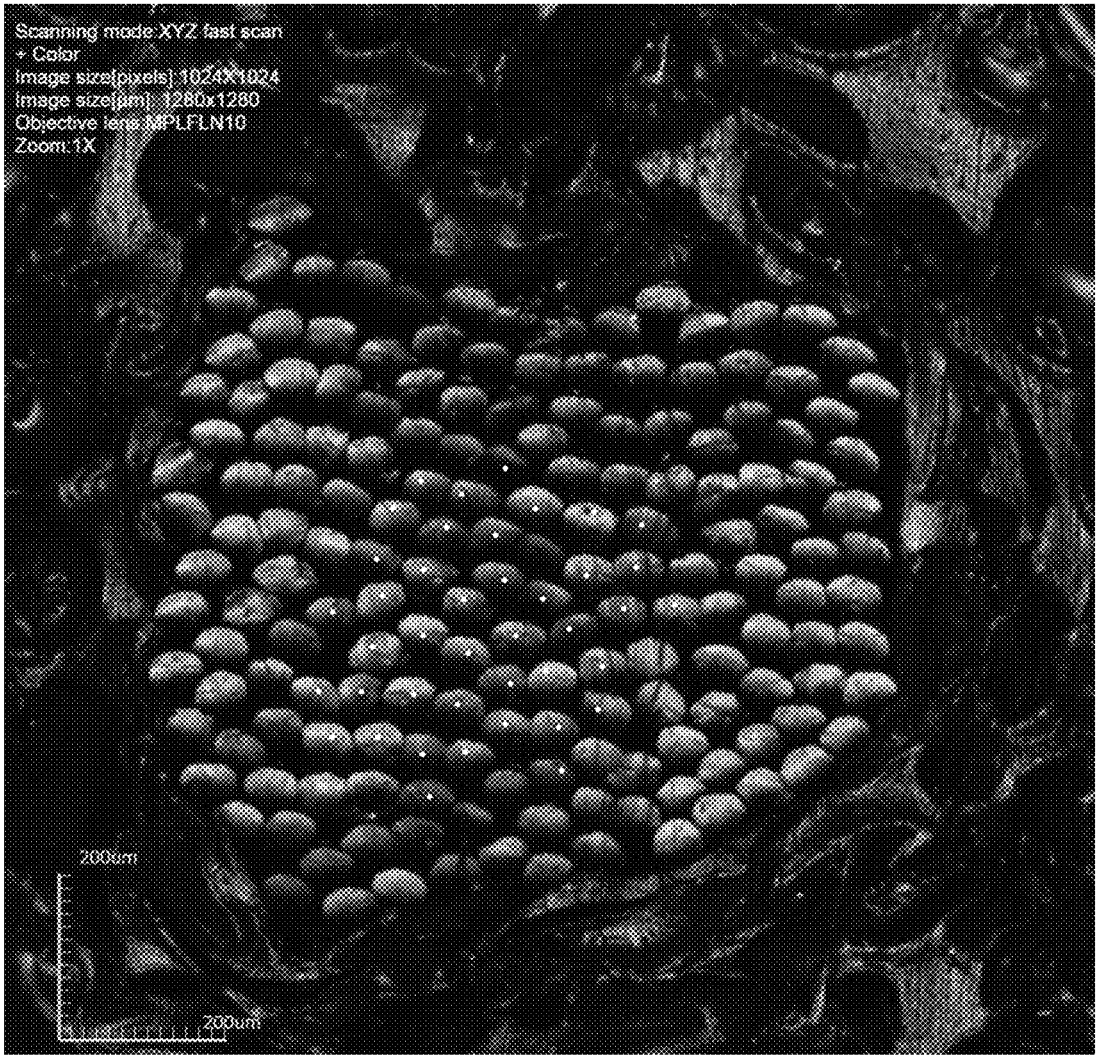
FIG. 3A and FIG. 3B are images of fibers prepared in the presence and absence of glucaric acid by confocal microscopy.

The Sample 1 fiber of FIG. 3A. is shown with an image size of 1280×1280 μm at 1× zoom. The fiber had an area of 1.8×10-9 $m^2$, a diameter of 48 μm, cellulose density of 1580000 $g/m^3$, denier 26, and decitex 29.

Figure 3B:
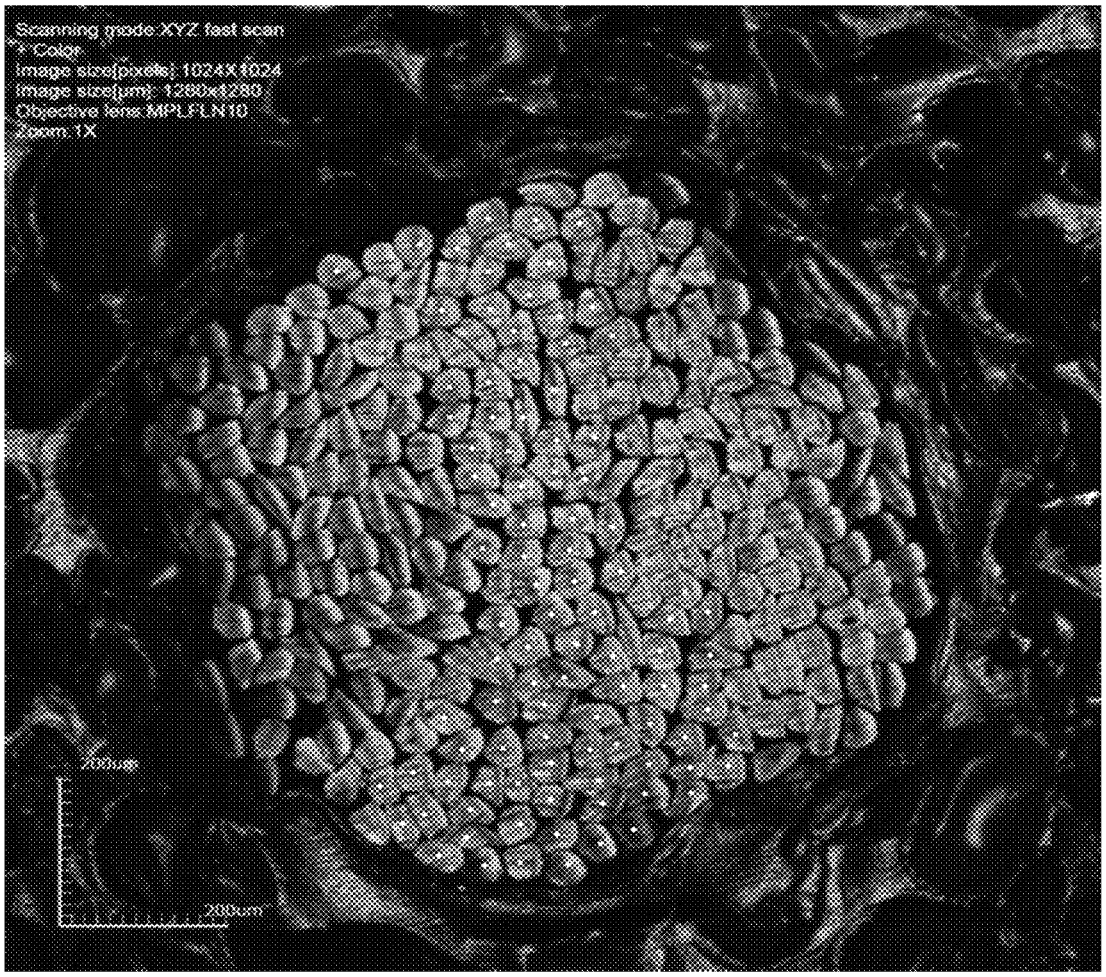

The Sample 2 fiber of FIG. 3B is shown with an image size of 1280×1280 μm at 1× zoom. The fiber had an area of 1.74×10-9 $m^2$, a diameter of 47 μm, cellulose density of 11500000 $g/m^3$, denier 23, and decitex 26.

EXAMPLE 5: DISSOLUTION TESTING

Figure 4B:
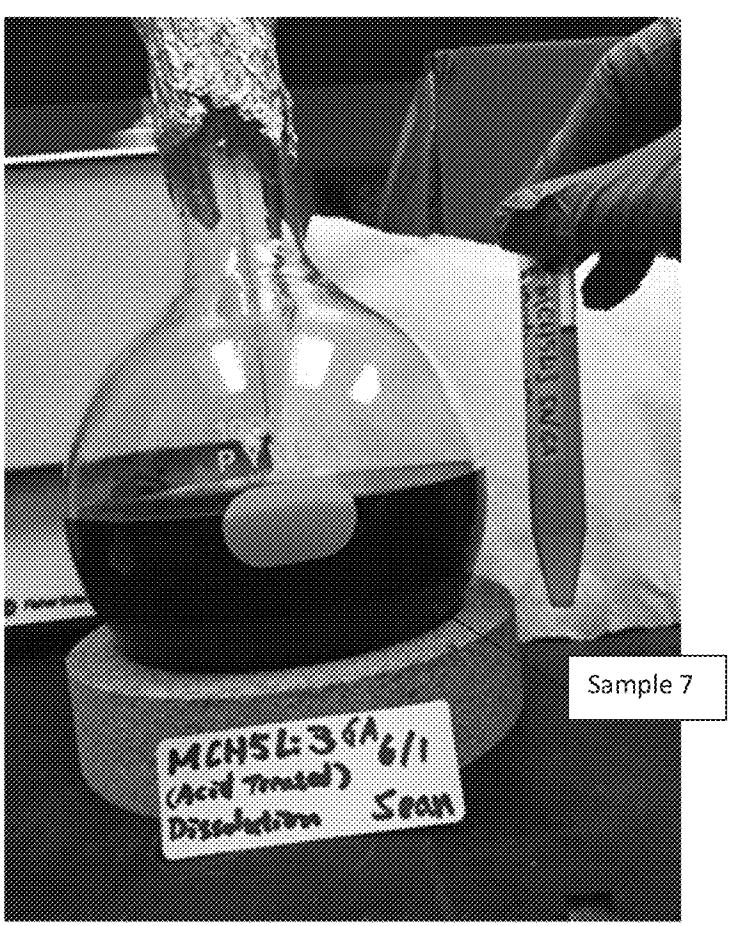
FIG. 4A and FIG. 4B are images illustrating dissolution of milled cotton samples in the absence and presence of glucarate.
Figure 4A:
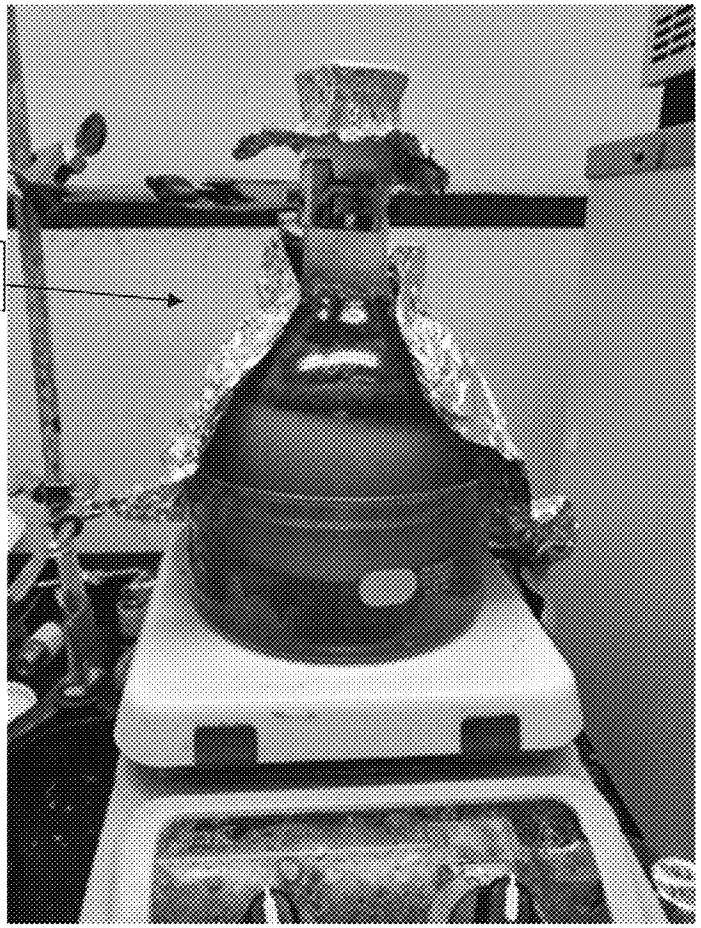

To prepare Sample 6, an oil bath was heated to 130° C. 4 grams LiCl and 0.1 grams lauryl gallate were added to 50 mL DMAc. The solution was heated in the oil bath for pre-heating. 1.5 grams treated cotton sample was added to the heated solution and stirred for 1 hour. The suspension was then cooled to room temperature and stirred for an additional hour, as shown in the photograph of FIG. 4A.

To prepare Sample 7, an oil bath was heated to 130° C. 4 grams LiCl, 0.1 grams lauryl gallate, and 0.15 grams glucarate were added to 50 mL DMAc. The solution was heated in the oil bath for pre-heating. 1.5 grams treated cotton sample was added to the heated solution and stirred for 1 hour. The suspension was then cooled to 70° C.-80° C., followed by a quick temperature quenching via tap water/manual shaking of the flask. It was observed by quenching the reaction that the fully dissolved condition suddenly appeared, shown in FIG. 4B.

Example 6: Pretreatment Role on Cellulose Dissolution

Experiments were conducted to evaluate the possible role of pretreatment operations on cellulose dissolution.

Sample 3 was prepared by subjecting a milled cotton sample (degree of polymerization 600-800) to a mercerization pretreatment. A 5% (wt/wt) milled cotton in 20% NaOH suspension was prepared. The suspension was stirred at room temperature for 5 hours. 400 mL of 4N sulfuric acid was then added to neutralize the suspension to pH 7.0. The sample was collected via filtration, and then oven dried at 80° C. it was observed that the sample fully dissolved during dissolution testing.

Sample 4 was prepared by omitting the mercerization pretreatment on a milled cotton sample (degree of polymerization 600-800). A 5% (m/wt) milled cotton in 20% NaOH suspension was prepared. The suspension was stirred at room temperature for 5 hours. The sample was then washed with water to neutralize to a pH of 7.0. The sample was collected via filtration, and then oven dried at 80° C.

Sample 5 was prepared by adding 20 grams of mercerized cotton cellulose from Sample 4 and treating with 400 mL. of 4N sulfuric acid for 30-40 minutes at room temperature. The sample was collected via filtration, and then washed with tap water to pH 7.0. The sample was then oven dried at 80° C. for 4 hours.

Figure 5:
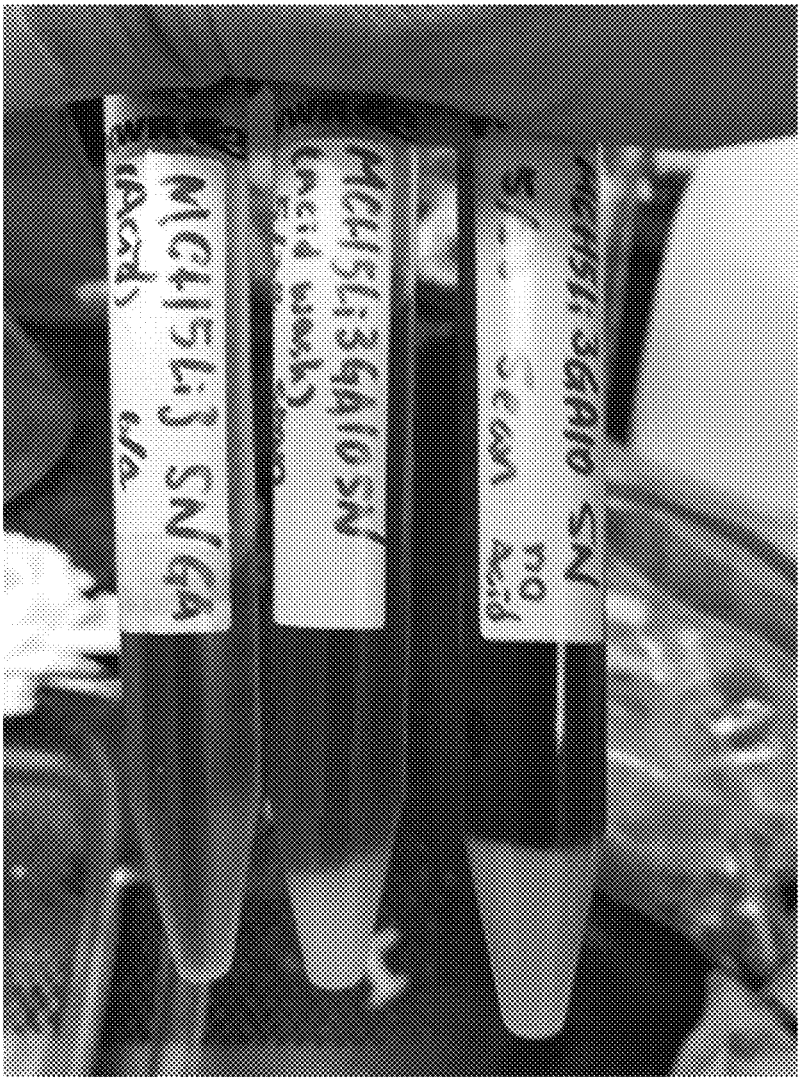
FIG. 5 is a photograph showing dissolution of a milled cotton sample with and without acid pretreatment and with drying after mercerization.

FIG. 5 is a photograph of, from left to right, Sample 3, Sample 4, and Sample 5. It was observed that without the acid treatment, Sample 5 exhibited a very poor cellulose dissolution performance, as shown in FIG. 5. It was further observed that with the additional acid treatment step (Sample 4), the cellulose dissolution improved (although still not fully dissolved).

Example 7: Crystallinity Testing of Milled Cotton Samples

Figure 6:
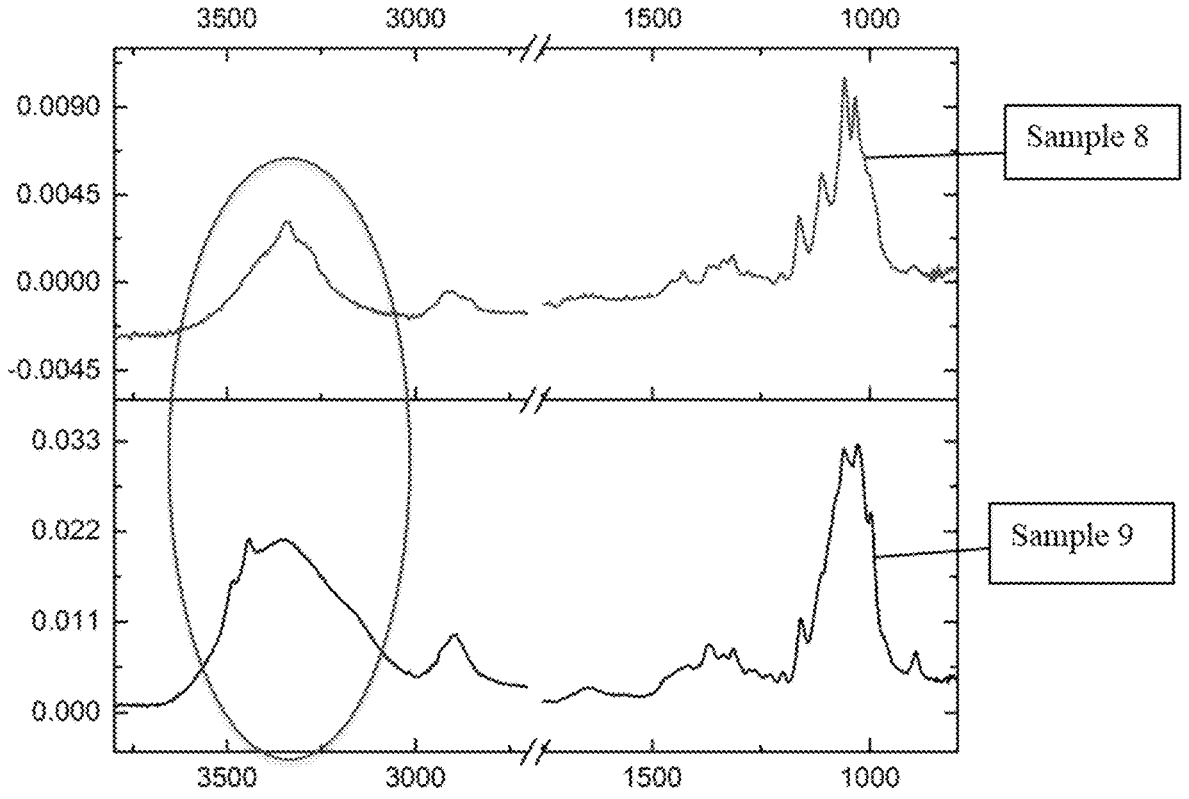
FIG. 6 is a line graph depicting a milled cotton sample before and after mercerization pretreatment.

Milled cotton sample before mercerization (Sample 8) and a milled cotton sample after mercerization (Sample 9) were compared, as shown in FIG. 6 below. The decrease of peak 1429 $cm^{-1}$ and the increase of peak 895 $cm^{-1}$ indicate the reduction of crystallinity after mercerization. The red oval indicates that cellulose intermolecular and intramolecular hydrogen bonding changed, pointing to a crystal structure transformation from cellulose I to II.

Example 8: Production of Knit Cellulose Fiber Samples

Figure 7B:
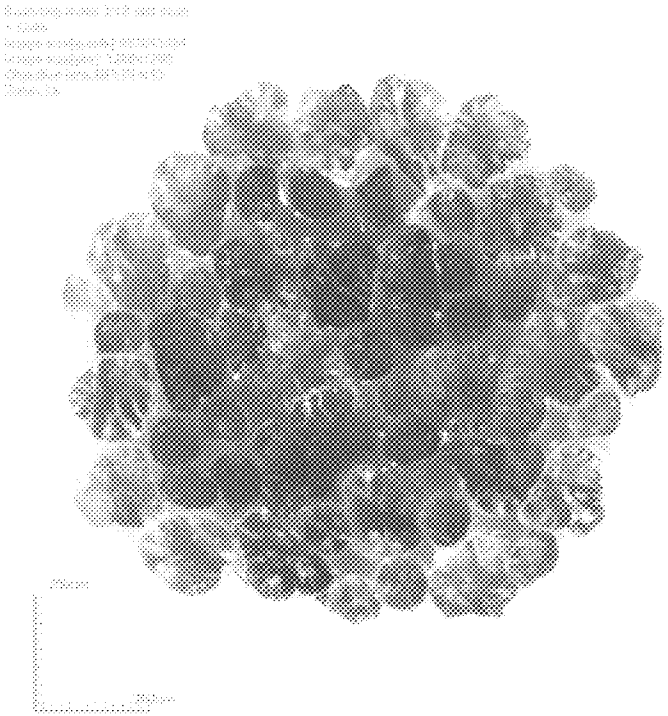
FIG. 7B is a confocal micrograph of the fiber cross sections from the 4-filament yarn of FIG. 7A.
Figure 7A:
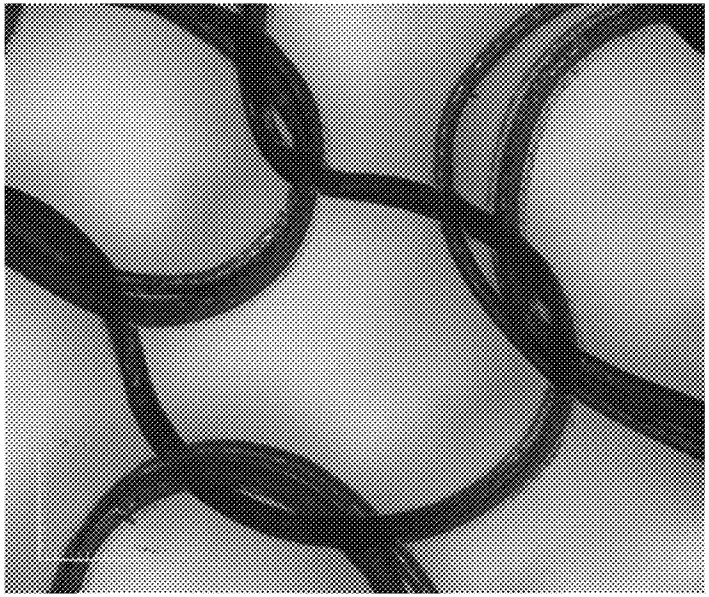
FIG. 7A is a photograph of a 4-filament yarn produced in accordance with some embodiments of the presently disclosed subject matter.

Cellulose fiber (600-800 degree of polymerization) from a shirt was obtained (3 wt % cellulose). A solution of 10% glucaric acid, 7% DMAc/LiCl, and 0.2% dodecyl gallate was prepared. The solution was subjected to a water coagulation bath. A 10 mL/min feed rate and 6-7 m/min take up speed were used to produce a 4 filament yarn, as shown in FIG. 7A and FIG. 7B.

Example 9: Physical Property Testing

Fibers of recycled cotton were milled into powder of short fibers. The average degree of polymerization for these fibers were 600-800 DP (i.e. medium DP). 5-8% weight to volume (w/v) of cellulose from recycled cotton to solvent. The solvent comprised 8 w/v % lithium chloride to dimethyl acetamide (LiCUDMAc) and 0.2 wt % lauryl gallate. Solutions were dissolved at 120° C. for 3 hours and stirred at room temperature for another hour. Solutions of spinning dope were centrifuged at 2500 rpm for 20 min. Spinning dopes were centrifuged to separate any undissolved powder for even more homogeneous dopes.

Five samples were tested, S1-S5, and are briefly described in Table 1 below. For samples S1, S4 and S5, the cotton was milled, mercerized, neutralized with 4N sulfuric acid, and dried at 80° C. For samples S2 and S3, the cotton was milled, mercerized, neutralized with 4N sulfuric acid, and dried at 80° C.

TABLE 1

Samples tested during Example 9

| Sample | Description: Weight/Weight percent additive to cellulose |
|---|---|
| S1 | Neat cellulose |
| S2 | 10% glucaric acid (GA)-cellulose |
| S3 | 10% GA-cellulose |
| S4 | 10% GA-cellulose |
| S5 | 10% galactaric acid (MA)-cellulose |

Various mechanical properties were experimentally obtained for each of samples S1-S5 and the results are detailed in Table 2, below. As used in Table 2, "gf" is gram force and denier=g/9000 m. Linear density measurements were obtained by following ASTM D1577 Standard Test Methods for Linear Density of Textile Fibers. Specific modulus values were obtained by following ASTM D3379-75(1989)e1 Standard Test Method for Tensile Strength and Young's Modulus for High-Modulus Single-Filament Materials (Withdrawn 1998). Tenacity values, including those shown in FIG. 9A and FIG. 9B, were obtained according to ASTM D3822 Standard Test Methods for Tensile Properties of Standard Textile Fibers.

Figure 8A:
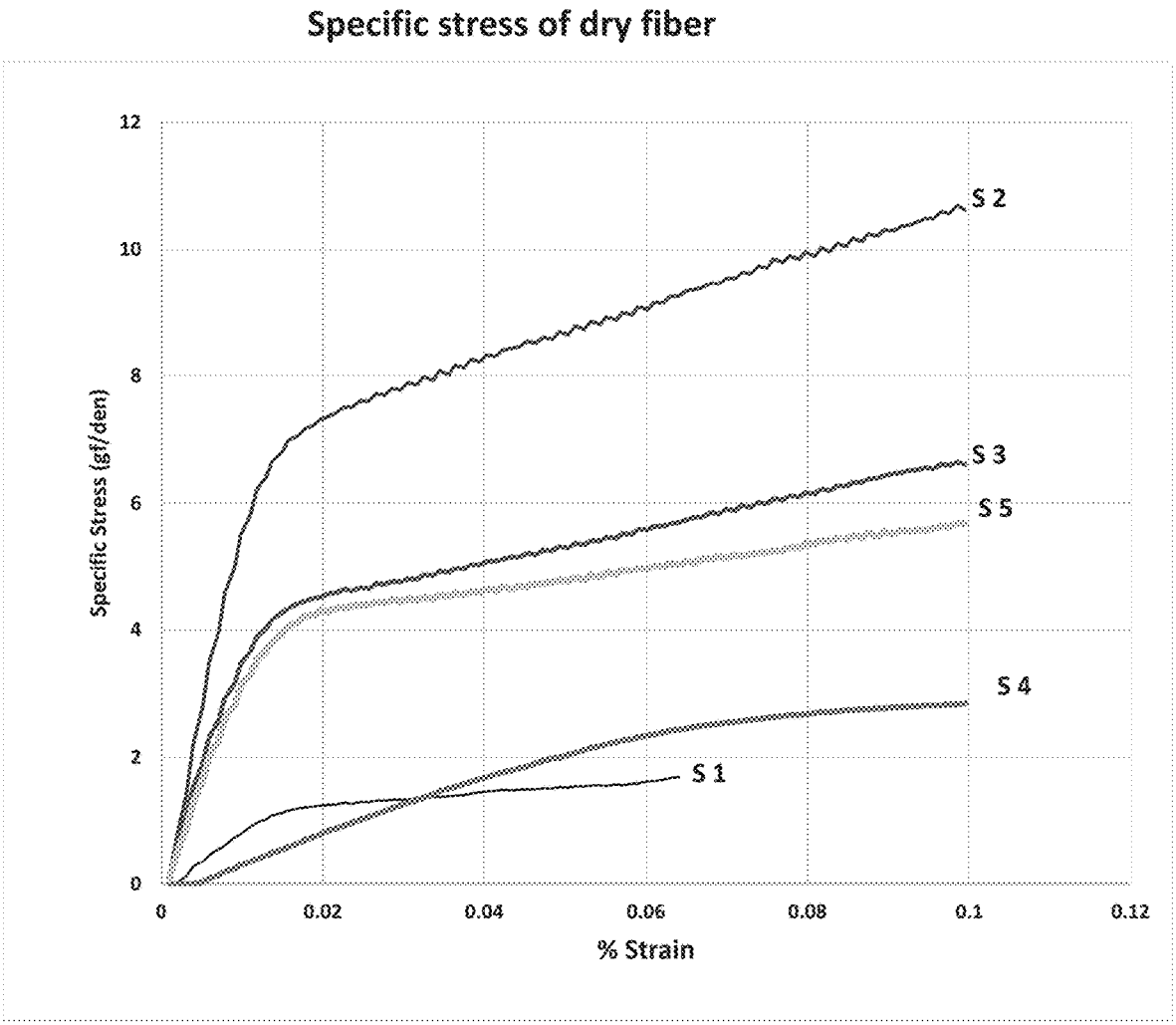
FIG. 8A shows tensile test data for dry condition samples and FIG. 8B shows tensile test data for wet condition samples.
Figure 8B:
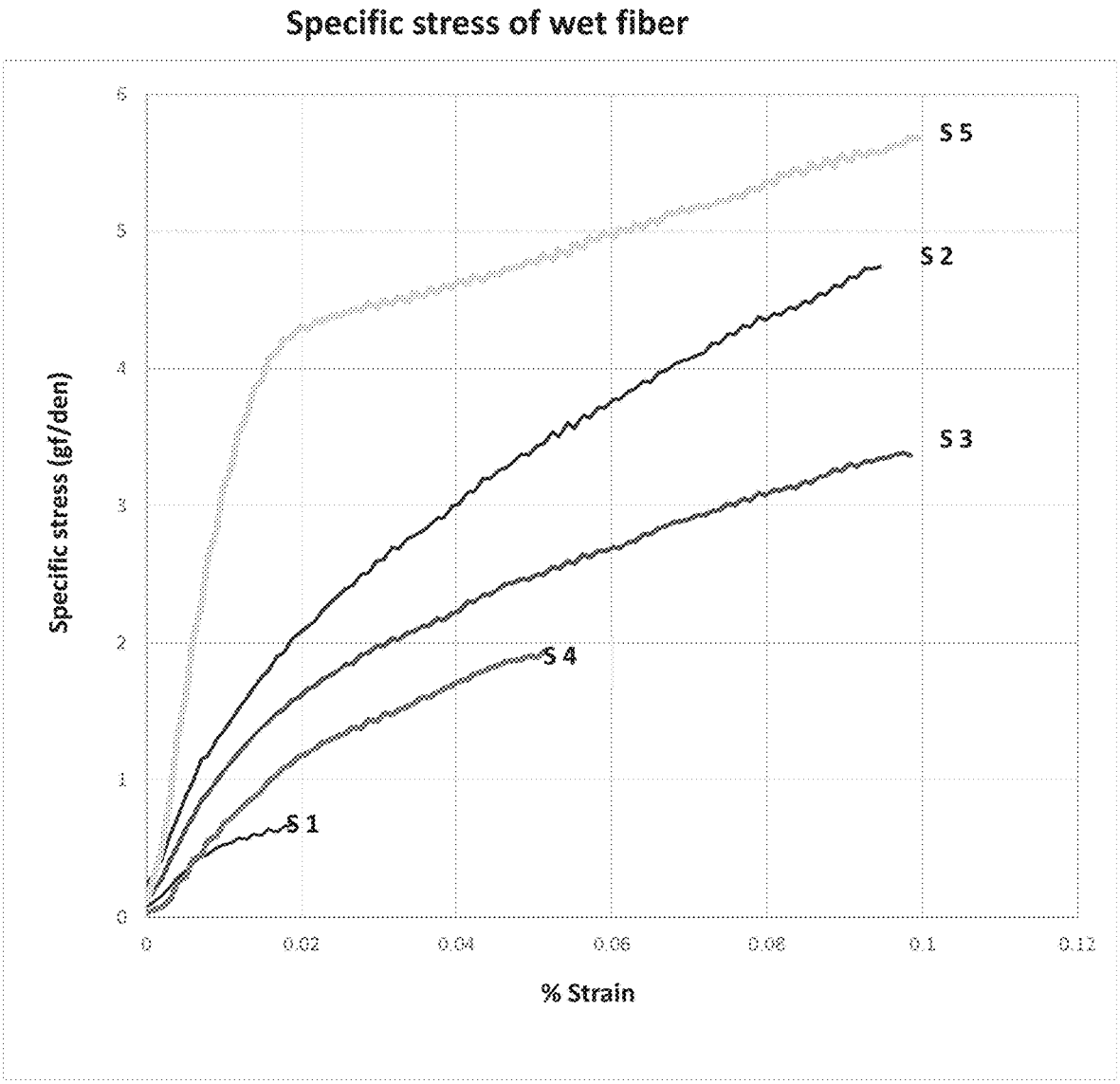

Tensile testing parameters: The tests were carried out at 25 mm gauge length with a crosshead speed of 15 mm/min of 5 lb load cells. At least 15 representative samples were tested, and most repeated mechanical properties were reported. FIG. 8A shows tensile test data for dry condition samples and. FIG. 8B shows tensile test data for wet condition samples. As shown in FIGS. 8A and 8B, the addition of aldaric acid improved the strength and drawability of the resultant fiber.

TABLE 2

Experimental results from tests performed on samples shown in Table 1.

| Sample | Description: Weight/Weight percent additive to cellulose | Linear Density (denier) | Dry condition Specific modulus (gf/denier) | Dry condition Tenacity (gf/denier) | Wet condition Specific modulus (gf/denier) | Wet condition Tenacity (gf/denier) |
|---|---|---|---|---|---|---|
| S1 | Neat cellulose | 7.6 | 129 | 2 | 80 | 0.7 |
| S2 | 10% glucaric acid (GA)-cellulose | 8.6 | 751 | 12 | 220 | 3.5 |
| S3 | 10% GA-cellulose | 6 | 480 | 7 | 153 | 3.4 |

TABLE 2-continued

Experimental results from tests performed on samples shown in Table 1.

| Sample | Description: Weight/Weight percent additive to cellulose | Linear Density (denier) | Dry condition Specific modulus (gf/denier) | Dry condition Tenacity (gf/denier) | Wet condition Specific modulus (gf/denier) | Wet condition Tenacity (gf/denier) |
|---|---|---|---|---|---|---|
| S4 | 10% GA-cellulose | 6.7 | 30 | 3 | 92 | 2.0 |
| S5 | 10% galactaric acid (MA)-cellulose | 5.7 | 390 | 9 | 101 | 3.0 |

Figure 9:
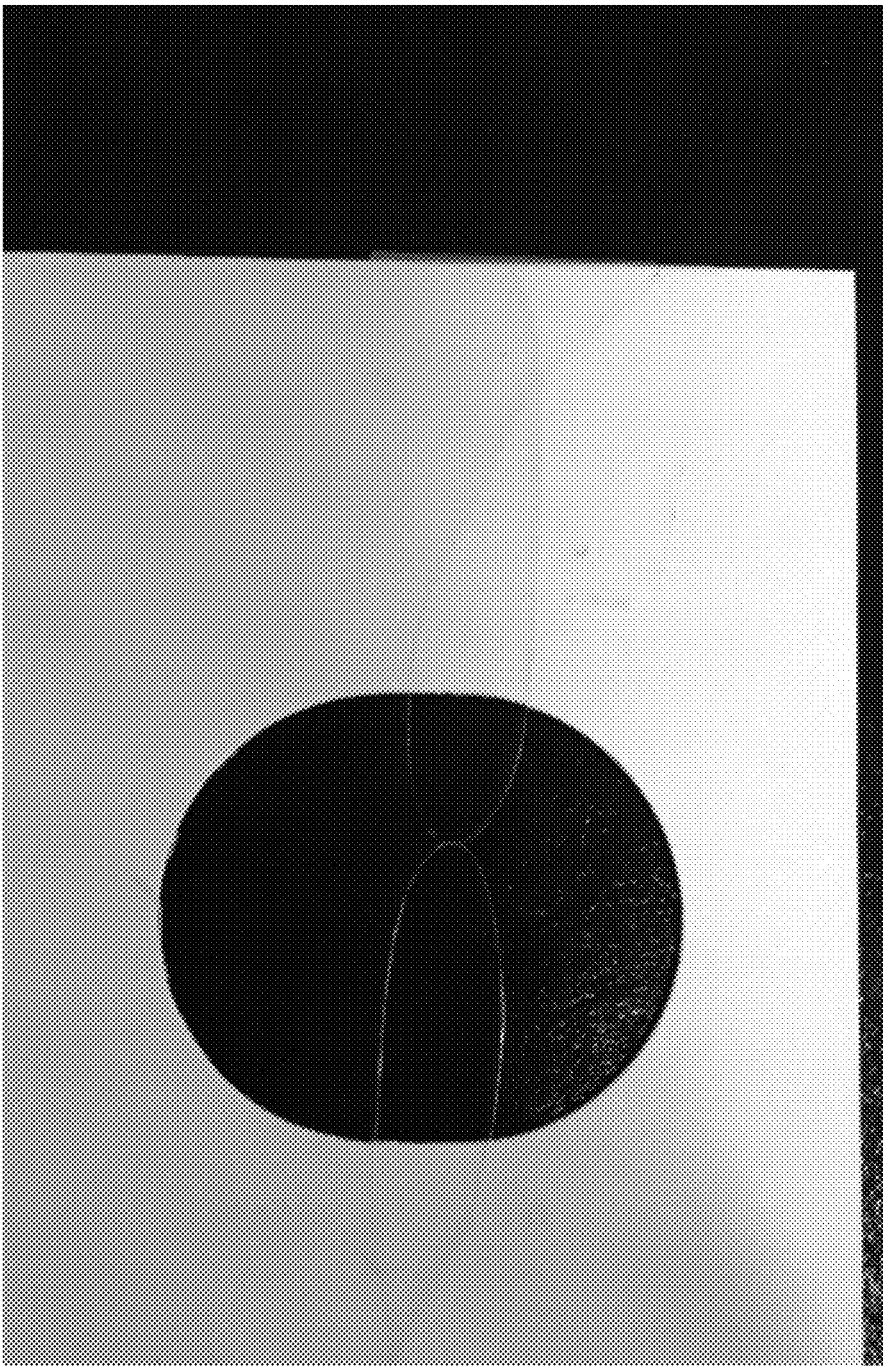
FIG. 9 is a photograph of an example fiber used for loop testing.

Loop testing was also performed on samples S1-S5. In particular, ASTM D3217 Standard Test Methods for Breaking Tenacity of Manufactured Textile Fibers in Loop or Knot Configurations was followed to obtain data shown in Table 3, below. Tensile testing parameters: The tests were carried out at 25 mm gauge length with a crosshead speed of 15 mm/min of 5 lb load cells. At least 15 representative samples were tested, and most repeated mechanical properties were reported. FIG. 9 is a photograph of an example fiber used for loop testing, specifically S2-10% glucaric acid-cellulose fiber.

TABLE 3

Loop testing experimental results.

| Sample | Description: Weight/Weight percent additive to cellulose | Linear Density (denier) | Specific modulus (gf/denier) | Tenacity (gf/denier) |
|---|---|---|---|---|
| S1 | Neat cellulose | 7.6 | 109 | 0.01 |
| S2 | 10% glucaric acid (GA)-cellulose | 8.6 | 675 | 0.10 |
| S3 | 10% GA-cellulose | 6 | 358 | 0.05 |
| S4 | 10% GA-cellulose | 6.7 | 164 | 0.02 |
| S5 | 10% galactaric acid (MA)-cellulose | 5.7 | 217 | 0.02 |

The foregoing detailed description and accompanying examples are merely illustrative and are not to be taken as limitations upon the scope of the disclosure. Various changes and modifications to the disclosed embodiments will be apparent to those skilled in the art. Such changes and modifications, including without limitation those relating to the chemical structures, substituents, derivatives, intermediates, syntheses, compositions, formulations, or methods of use, may be made without departing from the spirit and scope of the disclosure.

What is claimed is:

1. A method of processing cellulosic fiber, the method comprising:

combining cellulosic material and aldaric acid in a first solvent to produce a first mixture including 0.1-10 weight percent aldaric acid;

agitating the first mixture, thereby dissolving the cellulosic material and producing a cellulosic fiber solution;

extruding the cellulosic fiber solution into a first bath comprising a second solvent to provide an as-spun fiber; and thermally drawing the as-spun fiber through a second bath comprising oil at a temperature between 90° C. to 240° C. to produce a regenerated fiber.

2. The method according to claim 1, wherein the aldaric acid is glucaric acid.

3. The method according to claim 1, wherein the cellulosic material is present in the first mixture at a concentration of about 60% to about 99.9% by weight/volume.

4. The method according to claim 1, wherein the first solvent comprises sodium hydroxide, urea, N-methylmorpholine-N-oxide (NMMO) hydrate, dimethyl acetamide (DMAc), n-methylformamide (NMF), lithium chloride (LiCl), lithium bromide (LiBr), lithium fluoride (LiF), dimethyl sulfoxide (DMSO), dimethyl formamide (DMF), 1-methyl-2-pyrrolidinone (NMP), methyl-pyrrolidones, N-Methylmorpholine-N-Oxide (NMO), diallylimidazolium methoxyacetate ([A2im][$CH_3OCH_2COO$]), pyridinium, and imidazolium or combinations thereof.

5. The method according to claim 1, wherein the first solvent comprises dimethyl acetamide (DMAc) and lithium chloride, the lithium chloride being present in the solvent at from 3% to 9% weight/volume.

6. The method according to claim 1, wherein the second solvent comprises methanol, acetone, isopropanol, water, or combinations thereof.

7. The method according to claim 1, wherein the cellulosic material is activated cellulose powder.

8. The method according to claim 7, wherein the activated cellulose powder is derived from cotton waste or agricultural waste.

9. The method according to claim 1, further comprising:

neutralizing cellulosic material prior to combining cellulosic material with aldaric acid, and adding one or more additives to the cellulosic fiber solution.

10. The method according to claim 9, wherein the one or more additives include water repellants, coloring agents, UV stabilizers, UV absorbers, UV blockers, antioxidants, stabilizing agents, fire retardants, and combinations thereof.

11. The method according to claim 1, further comprising aging the as-spun fiber to provide an aged as-spun fiber, where the aged as-spun fiber is subjected to drawing.

12. The method according to claim 1, further comprising generating the cellulosic material by a method including:

milling cellulose starting material to generate a fine cellulose powder;

mercerizing the fine cellulose powder in aqueous sodium hydroxide;

neutralizing the mercerized solution with an acid;

rinsing and collecting fibers in the mercerized solution; and drying the fibers.

13. A regenerated cellulosic fiber produced by the method of claim 1.

14. The regenerated cellulosic fiber according to claim 13, comprising an average fiber diameter of about 10-50 μm.

15. The regenerated cellulosic fiber according to claim 13, comprising a tenacity of 3-15 g/den.

16. The regenerated cellulosic fiber according to claim 13, comprising a specific modulus of 200-1200 g/den.

17. The regenerated cellulosic fiber according to claim 13, comprising a tensile strength of 150-2000 MPa.

18. The regenerated cellulosic fiber according to according to claim 13, comprising a linear density of 3-30 denier.

19. The regenerated cellulosic fiber according to claim 13, wherein the fiber is melt-blown, spunbond, or as-spun.

20. A fibrous article comprising the fiber according to claim 13.

21. The fibrous article according to claim 20, wherein the article is selected from the group consisting of yarn, fabric, melt-blown web, spunbonded web, as-spun web, thermo-bonded web, hydroentangled web, nonwoven fabric, or combinations thereof.

* * * * *